US005620145A

United States Patent [19]

Masuda

[11] Patent Number: 5,620,145

[45] Date of Patent: Apr. 15, 1997

[54] HIGH-SPEED PULVERIZING METHOD AND EQUIPMENT

[75] Inventor: Tsuneo Masuda, Kawaguchi, Japan

[73] Assignee: Masuko Sangyo Co., Ltd., Kawaguchi, Japan

[21] Appl. No.: 361,364

[22] Filed: Dec. 22, 1994

[30] Foreign Application Priority Data

Dec. 27, 1993 [JP] Japan ..... 5-348616
Oct. 31, 1994 [JP] Japan ..... 6-290388

[51] Int. Cl.[6] ..... B02C 7/11

[52] U.S. Cl. ..... 241/19; 241/80; 241/261.2

[58] Field of Search ..... 241/30, 79.1, 261.2, 241/261.3, 80, 97, 19, 56, 24.1; 209/3, 932, 138, 140, 141

[56] References Cited

U.S. PATENT DOCUMENTS

| | | | |
|---|---|---|---|
| 4,109,873 | 8/1978 | Lichfield . | |
| 4,204,005 | 5/1980 | Kudo et al. | 241/261.2 X |
| 4,700,900 | 10/1987 | Rowland | 241/261.2 X |
| 4,752,037 | 6/1988 | Farris et al. | 241/79.1 |

FOREIGN PATENT DOCUMENTS

| | | |
|---|---|---|
| 417479 | 11/1910 | France . |
| 1507574 | 7/1969 | Germany . |
| 1757516 | 2/1972 | Germany . |
| 60-122052 | 6/1985 | Japan . |
| 734593 | 8/1955 | United Kingdom . |
| 775196 | 5/1957 | United Kingdom . |
| 2168988 | 7/1986 | United Kingdom . |

*Primary Examiner*—Mark Rosenbaum
*Attorney, Agent, or Firm*—Oblon, Spivak, McClelland, Maier & Neustadt, P.C.

[57] ABSTRACT

A high-speed fine pulverizer wherein a fixed top grindstone is mounted in a pulverizing chamber with a reduced pressure-tolerable mechanism, a rotating bottom grindstone is arranged in opposition thereto and mounted firmly to a rotating disk with a plurality of ejection wings for reduced pressure and disposed around the rotating grindstone, and an intensive reduced-pressure jet stream is caused by the high-speed revolution of rotating bottom grindstone to such air from a central opening of fixed grindstone, thereby forcedly passing the pulverizing raw material fed from said opening through the clearance between both grindstones at high speed while whirling it so as to be finely pulverized, wherein the pulverizing raw material can be pulverized finely at ambient temperature without a rise in temperature, allowing the conversion of foods etc. to powder without thermal transmutation. The invention can also include equipment for producing finely pulverized powder, including a high-speed fine pulverizer and an air classifier.

5 Claims, 9 Drawing Sheets

HIGH-SPEED PULVERIZING METHOD AND EQUIPMENT

BACKGROUND OF THE INVENTION

1. Field of the Invention

The present invention relates to a high-speed finely pulverizing method employed for generating reduced pressure jet stream and the equipment therefor.

2. Discussion of the Background

Conventional pulverizers adopting a mill principle generate heat due to the thermal conversion of energies such as those of compression, shear and rolling friction generating in the pulverizing process, when finely pulverizing materials containing high lipid, high moisture, high protein, or a high amount of saccharide or special enzyme, resulting in very difficult fine pulverization due to sticking caused by bleeding of lipid, adherence caused by moisture, burning caused by oxidizing metamorphosis etc., film formation, and the like.

Moreover, since heat generation is proportional to the number of revolutions, a low speed is used without exception in order to suppress heat generation.

Showing a typical example using stone mortar, 156 rpm is used for traditional goods such as ground tea (Uji Tea Research Laboratory), leading to extremely low capacity (40 g–100 g/h). Hence, 1,000 stone mortars are working at same factory.

Furthermore, there is a compressive pulverization system using rolls as a low-speed fine pulverizer. This is superior for the pulverization at ambient temperature, but the capacity is very low because of low speed, hence the operation required increased cost and was difficult economically to be utilized.

Now, a lot of powder-producing machines have been used so far in various industrial sectors. As a representative of super colloid mill being one example thereamong, there is Mass Colloider (trade name) that efficiently provides super fine powder of hard pulverizing materials. This is constituted by a fixed top grindstone having a flat grinding area at an outer circumference, the width thereof being freely adjustable, and a rotating bottom grindstone having flat grinding area similarly at outer circumference and being rotatable at high speed, arranged so that their flat grinding areas are in opposition one another, and the pulverizing material fed between these grindstones from a central opening of the fixed grindstone is super finely pulverized by means of overall actions of centrifugal force, impact grinding force, shear force, etc. caused between said opposed flat grinding areas.

The life of such super colloid mail and Mass Colloider lies in the built-in grindstones.

In particular, with hard pulverizing materials, that is, materials containing high lipid, high moisture, high protein, or a high amount of saccharide or special enzyme, the lipid, moisture, protein and enzyme peculiar to pulverizing materials adhere, stick, burn or form a film due to heat of friction to vary the physical properties, thus having made it impossible to be commercialized as powders. For avoiding these, if widening the clearance between grindstones occurs, then the transmutation phenomenon due to heat generation may be improved slightly, but fine pulverization is impossible. Reduction of the number of revolutions of the grindstone may improve this to some extent, but stable operation is impossible together with decreased capacity. Also, if the aperture of grindstones is increased, then the peripheral speed of grindstone increases even at low-speed revolutions, leading to subtle changes in heat generation, adherence, sticking, burning, film formation, etc.

Based on conventional concepts, it has been considered that the number of revolutions and the peripheral speed have the same implication because of proportionality between the number of revolutions and the peripheral speed. During repeated tests, however, it has been found that, when the number of revolutions and the peripheral speed exceed certain lines, a change for the better is seen suddenly in the pulverizing capacity.

Increasing the peripheral speed further, it has been found that a large capacity can be exerted almost without raising the temperature even for the extremely hard pulverizing materials that have been hitherto considered to be quite impossible.

As a result of having repeated the tests varying the number of revolutions variously with respective grindstones, a remarkable change in powdering of hard pulverizing materials was recognized at a peripheral speed of over 1850 m/min, preferably over 2200 m/min in all cases, as shown in Table 1.

TABLE 1

| No | Diameter of grindstone ϕ, mm | Number of revolutions, rpm | Peripheral speed, m/min | Remarks |
|---|---|---|---|---|
| 1 | 150 | 5000 | 2350 | Good powder for hard pulverizing materials Overheating of motor |
| 2 | 240 | 3000 | 2250 | Best current value, capacity and material temperature (Best safety and machine cost) |
| 3 | 360 | 2000 | 2260 | Good |
| 4 | 500 | 1450 | 2276 | Good Difficulty in machine cost |
| 5 | 750 | 1000 | 2360 | Good Difficulty in machine cost |
| | | 1450 | 3422 | Safety? |

Moreover, when attempting to classify the powder obtained particularly by dry pulverization with said super colloid mill, clogging is liable to occur, if using a usual air classifier with screen, thus having posed a problem in installing an automatic production line for powder.

SUMMARY OF THE INVENTION

The high-speed pulverizing method of the invention is characterized in that, in the method wherein a rotating grindstone having a flat grinding area at an outer circumference and a fixed grindstone having flat grinding area similarly at the outer circumference are arranged concentrically so that their flat grinding areas are in opposition one another, and, while feeding the pulverizing taw material from an opening of fixed grindstone under the revolution of said rotating grindstone, said pulverizing raw material is ground, pulverized and ejected from the clearance between opposed flat grinding areas of both grindstones, a plurality of ejection wings for suction facing the clearance between opposed flat grinding areas of both grind stones are firmly provided around said rotating grindstone and high-speed revolution sufficient to cause a reduced-pressure jet stream between opposed faces of both grindstones is given to said rotating grindstone. At that time, it is important that the high-speed revolution to be given to rotating grindstone is not lower than 1850 m/min, that each width in the radial direction of opposed flat grinding areas of both grindstones is not more than 25 mm and that the clearance between opposed flat grinding areas of both grindstones is from 100 to 3,000 μm.

Moreover, the method for producing finely pulverized powder of the invention is characterized in that it comprises said high-speed pulverizing process and a process wherein the powder obtained from said process is allowed to rise on an atomized scale by feeding it into a top-through-bottom penetrated passage in the shape of inverted truncated cone placed in a rising jet stream in a lower casing caused by air entering from lower end opening due to the suction force from upper portion to classify it through a classification screen at upper end of said lower casing where high-pressure air is blown against from above, and the fine powder passed through the classification screen is conveyed to the next process via an exit after being sucked in an upper casing unified with said lower casing and the powder not passing through said classification screen is ejected from lower end opening of a lower casing to return it again to the process for grinding and pulverization.

Moreover, the equipment for producing finely pulverized powder of the invention is characterized in that it comprises an ambient temperature high-speed fine pulverizer wherein a fixed top grindstone with radial deep-engraved feed grooves and flat grinding area at outer circumference is mounted in a pulverizing chamber with a reduced pressure-tolerable mechanism and a rotating bottom grindstone with radial deep-engraved feed grooves and a flat grinding area at an outer circumference installed in opposition to said fixed top grindstone is mounted firmly to a rotating disk with a plurality of ejection wings for suction disposed around it, and an intensive reduced-pressure jet stream is caused by the high speed revolution of rotating the bottom grindstone to suck air from central opening of fixed grindstone and create a spinlike revolutionary high-speed stream in the direction of revolution of rotating grindstone in the clearance between fixed grindstone and rotating grindstone, thereby forcedly passing the pulverizing raw material fed from said opening through the clearance between both grindstones at high speed while whirling it to pulverize finely while absorbing the intensive temperature-raising energy due to rolling, shear, compression, heat of friction, etc. generated on pulverization with said jet stream to exert a cooling effect on grindstones, and an air classifier wherein a jet vessel with top-through-bottom penetrated passage in the shape of inverted truncated cone provided at the tip of feed pipe to introduce the powder obtained through said fine pulverizer is installed in a lower casing having an opening at lower end, an upper casing having a powder exit connected to external air suction source is provided on said lower casing, a classification screen separating a lower casing space from an upper casing space is provided at the boundary of these casings, an air brush for a screen to blow high-pressure air against said classification screen is provided above said classification screen, and further a lower end of the lower casing is installed in a powder recovery case with an external air-introductory port and freely detachable powder-accommodating port at a lower portion thereof, thus atomizing the powder introduced from said feed pipe by means of a rising jet stream of air in the jet vessel sucked from the lower end opening of lower casing and classifying into undersized powder the powder passing through classification screen and ejecting from the powder exit and oversized powder not passing through said classification screen and falling and being deposited in the powder-accommodating pot. At that time, it is effective to make the classification screen circular and to mount an air brush consisting of a hollow straight tube with air-purging slits formed in the longitudinal direction to the rotating axis installed longitudinally above the center of said circular classification screen, thus being structured to revolve so that the high-pressure air spouts out over the overall top surface of said classification screen. Moreover, it is better to directly connect the ejecting port of said high-speed fine pulverizer to the entrance of feed pipe of said air classifier.

Furthermore, the air classifier to be used exclusively for said inventive equipment is characterized in that a jet vessel with top-through-bottom penetrated passage in the shape of an inverted truncated cone provided at the tip of feed pipe to introduce the powder is installed in a lower casing having an opening at a lower end, an upper casing having a powder exit connected to external air suction source is provided on said lower casing, a circular classification screen separating a lower casing space from upper casing space is provided at the boundary of these casings, an air brush consisting of a hollow straight tube with air-purging.slits formed in the longitudinal direction is mounted on a rotating axis installed longitudinally above the center of said circular classification screen to revolve so that the high-pressure air spouts out over the overall top surface of said circular classification screen, an air brush consisting of a hollow pipe with air-purging slits formed in the longitudinal direction is mounted on the rotating axis installed in said upper casing to revolve so that the high-pressure air spouts out over the overall inner wall surface of upper casing, and further a lower end of lower casing is installed in a powder recovery case with an external air introductory port and freely detachable powder accommodating pot at lower portion, thus atomizing the powder introduced from said feed pipe by means of a rising jet stream of air in the jet vessel sucked from the lower end opening of the lower casing and being classified into undersized powder passing through a circular classification screen and ejecting from a powder exit and oversized powder not passing through said screen so as to fall and be deposited in the powder-accommodating pot.

BRIEF DESCRIPTION OF THE DRAWING

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
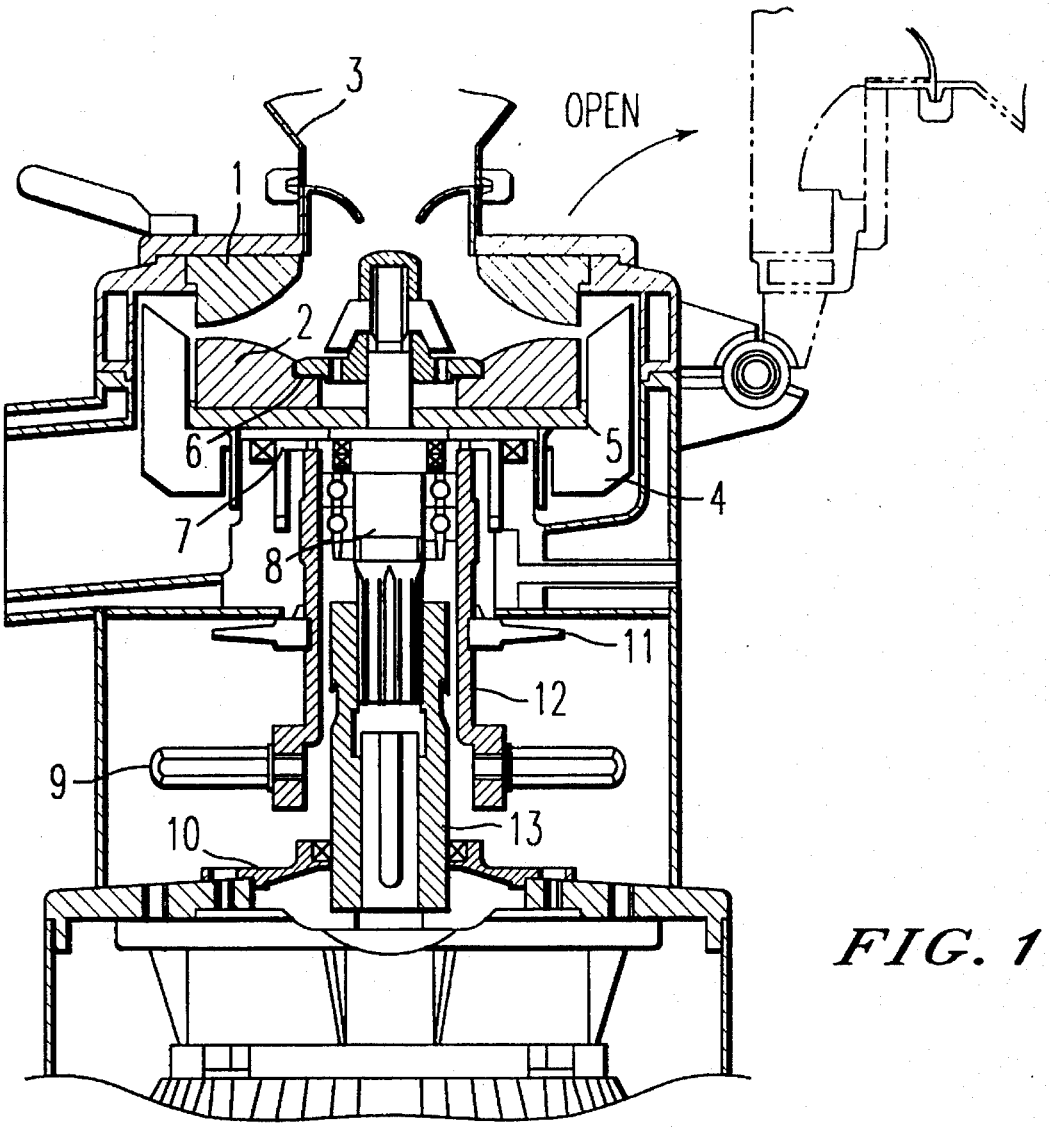
FIG. 1 is a diagram showing the longitudinal section of high-speed fine pulverizer of the invention.

As the rotating grindstone and fixed grindstone to be used in the invention and grinding (pulverizing) equipment employed, the Mass Colloider developed by the inventor (Japanese Patent Publication No. Sho 62-51658, Nos. Hei 3-1061 through 1064, No. Hei 4-55830, Design Nos. 655304 and 845632, etc.) is used.

(1) Grindstone

On the opposed faces of both grindstones except flat grinding areas at the outer circumference, radial deep-engraved feed grooves somewhat inclined in the opposite direction to the revolutionary direction of the grindstone are provided, respectively. This is because of the fact that, by engraving deeply, the feeding action of pulverizing raw material requires a very large amount of work, and the depth, arrangement, etc. are adjusted appropriately depending on the grain size of grindstone in the flat grinding area at the outer circumference of grindstone.

(2) Ejection Wings for Suction

Usually, a plurality of ejection wings for suction are fixed around a metallic rotating disk holding a rotating grindstone at equal intervals in the circumferential direction, and these ejection wings for suction are provided so that their tips face the clearance between opposed flat grinding areas of both grindstones.

(3) Width of and Clearance Between Flat Grinding Areas of Grindstones

The width in the circumferential direction of flat grinding areas formed at the outer circumference of both grindstones is set to be not more than 25 mm and the mutual distance (clearance) between opposed flat grinding areas of both grindstones is set to be 100 to 3,000 μm, respectively. This is for preventing a rise in temperature due to rolling, shear, compression, heat of friction, etc. on pulverization to guarantee substantial ambient temperature fine pulverization.

(4) Peripheral Speed of Rotating Grindstone

This is desirably not lower than 1,850 m/min, preferably not lower than 2,200 m/min. This is because of causing a fully intensive jet stream between faces of both grindstones combined with the action of ejection wings for suction as described above, thus generating a spin-like revolutionary high-speed stream between the faces of the grindstones in the direction of revolution of the motor and forcedly passing the pulverizing raw material fed quantitatively through the clearance between flat grindstone areas at high speed while whirling it.

(5) Type of Grindstone

This is determined according to Japanese Patent Publication No. Sho 62-51658, Nos. Hei 3-1061 through 1064 and No. Hei 4-55830 developed by the inventor.

(6) When the pulverizing raw material is a material liable to be oxidized, blowing nozzles of inert gas ($N_2$, $CO_2$ gas or the like) are sometimes mounted to the feed hopper for pulverizing raw material located at the opening of a fixed grindstone.

(7) When the pulverizing raw material comprises particles or a material with low specific gravity, there is a fear of back spouting at the same time as throwing-in thereof, hence nonreturn metal fittings are sometimes attached to the hopper throwing-in port as described above.

(8) Pulverizing Chamber with Reduced Pressure-Tolerable Function

As described above, since a intensive reduced-pressure jet stream is caused between both grindstones by high-speed revolution of the rotating grindstone, it becomes necessary for equipment to mount both grindstones in a pulverizing chamber with a reduced pressure-tolerable function.

For increasing the effect of said reduced-pressure jet stream, application of the grinding method and equipment in a vacuum or anaerobic gas atmosphere (Japanese Unexamined Patent Publication No. Hei 3-16656) developed by the inventor will be more effective. It is effective since dry grindings of food prime materials in danger of oxidative metamorphosis, powders in danger of explosion, and the like can be performed safely and efficiently.

Moreover, the invention allows one to perform the fine pulverization at ambient temperature and at high speed through such high-speed pulverizer and to classify the finely pulverized powder to obtain fine powder with a uniform particle size.

At this time, the constitution is such that the classifying powder is allowed to rise and be supplied to a classification screen from an underside portion thereof. In the case of such powder supply from the underside, the flying-up atomizing effect of oversized powder is increased, hence it is necessary to make the size of the casing larger than that when supplying from the topside thereof. For this reason, upon extending the feed pipe to the center of casing and attaching a jet vessel to the tip thereof to supply the powder here, then the flying-up powder is prevented from being whirled into a gyrating stream generated in the casing due to the diffusive effect from the center by said jet vessel and the synergistic effect of a suction force from the upper portion with diffusive action of secondary air from lower end exists, allowing the supply of the raw material powder to the overall surface of classification screen. And, since high-pressure air is blown against this classification screen from above, the oversized powder is blown away downward by this high-pressure air and is ejected from a lower end opening of a lower casing, resulting in the clogging of screen being difficult to occur.

In contrast thereto, if supply of the powder from the topside of classification screen occurs with conventional air classification, the gyrating force of air is utilized to eject the oversized powder outside the machine, but the gyrating force tends to exceed the suction force, and hence the undersized powder is not attracted by the suction force. As a result, it does not pass through the screen, but gradually begins to remain above said screen and make the concentration of powder higher, finally leading to clogging.

In following discussion, examples of the invention will be shown.

EXAMPLE 1

Figure 2:
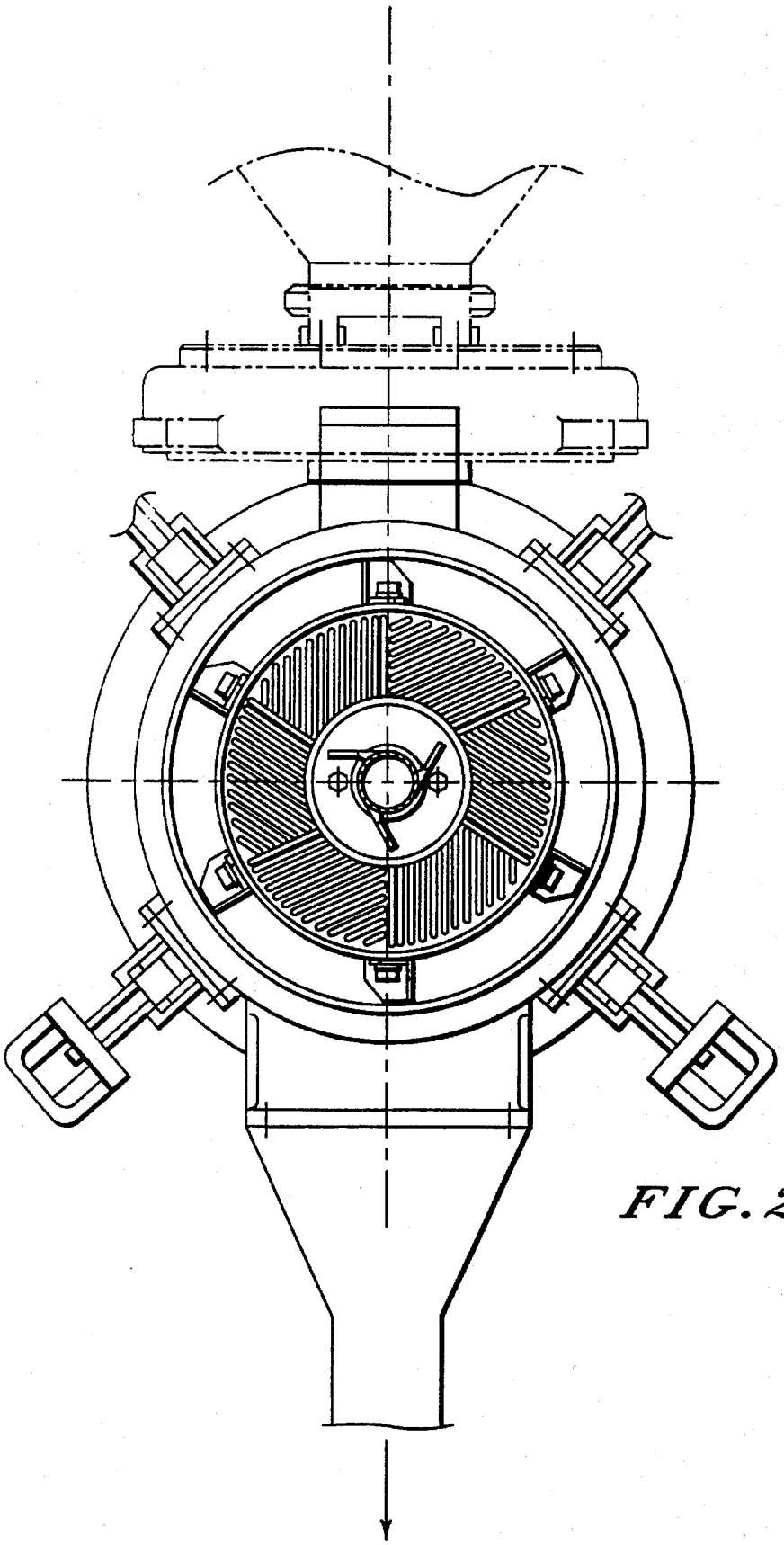
FIG. 2 is a plan view of pulverized with the upper chamber opened.

First, an example of the inventive high-speed fine pulverizers is shown in FIG. 1 and FIG. 2.

An upper chamber which houses a deep-groove type fixed grindstone (1) and a lower chamber housing a deep-groove type rotating grindstone (2) are made to be freely openable by a hinge as indicated by dotted lines, which are unified to constitute a pulverizing chamber with reduced pressure-tolerable function. Onto a hopper for feeding pulverizing raw material in upper chamber, metal fittings (3) for preventing the return of powder flow are attached. The rotating grindstone (2) is fixed to a rotating disk (5) provided therearon with a plurality of ejection wings (4) at equal intervals in the circumferential direction. Numeral (6) indicates metal fittings for pressing down the stone, numeral (7) a bearing cover, numeral (8) a shaft, numeral (9) a hexagon handle, numeral (10) a waterproof board, numeral (11) a lock handle, numeral (12) an up and down handle, numeral (13) a joint, and numeral (14) an ejection port for the pulverized product, respectively.

Using the inventive equipment, dry pulverizations of raw white sesame with hulls, raw black sesame with hulls, raw peanut, raw coconut, butter peanut, buckwheat flour and tea plant leaves were carried out. As a result, it was possible to finely pulverize them to fine powder ranging from 150 to 300 mesh, respectively, at ambient temperature without varying their physical properties.

As other pulverizing (grinding) raw materials applicable the inventive method, the following can be mentioned.

Foods

Soybean (raw), peanut (roasted, raw), raw coconut, raw almond, rice (raw), wheat (raw), corn (raw), millet (raw), buckwheat (raw) and fruit of lotus (raw)

Favorite Foods

Tea (ground, green and black), raw or roasted coffee bean and raw or roasted sesame (white and black)

Spices

Red pepper and pepper

Crude Drugs

Cassia bark, cinnamon, cumin, coriander, fennel and cardamon

Seasonings

Sugar and salt

Whole, part or product of animals and plants having effective ingredient as a medicinal drug, grass root, wood bark, horn of rhinoceros, etc.

Spices

Vegetable substances with aroma used for the seasoning of food

Favorite foods

Food and drink for obtaining smell, taste or stimulus, aiming at no nutritive intake Foods Generic term of matters intaking daily as foods Groceries With respect to 3000 rpm dry-pulverizing test by the inventive high-speed fine pulverizer:

| | |
|---|---|
| | ① Raw white sesame with hulls |
| clearance 200μ | to become paste at the article temperature of 80–90° C. |
| clearance 4 mm | The article temperature is hardly raised to give grinded sesame |
| | ② Raw black sesame with hulls |
| clearance 1 mm | The article temperature is hardly raised to give coarse paste |
| clearance 4 mm | The article temperature is not raised to give grinded sesame. |
| | ③ Raw peanut, Butter peanut |
| clearance | The article temperature is hardly raised to give granular. |
| | ④ Butter peanut |
| clearance 200μ | to give past at the article temperature of about 60° C. |
| | ⑤ Buckwheat |
| clearance 400μ | to give powder at the article temperature of about 30° C. |

*Only the sweet hulls are coarse and so it becomes powder when reintroduced into the high-speed fine pulverizer. If the clearance becomes narrower, it possibly becomes powder by one operation.

| | |
|---|---|
| | ⑥ BEE POLLEN (spice) |
| clearance 300μ | The article temperature is hardly raised to give powder. |
| | ⑦ FELLEN (spice) |
| clearance 500μ | The article temperature is hardly raised to give powder. |
| | ⑧ Tea |
| clearance 100μ | The article temperature is hardly raised to give powder. |
| clearance 200μ | The article temperature is hardly raised to give powder. |

As described, the inventive high-speed fine pulverizer causes an intensive reduced-pressure jet stream between faces of both grindstones by the high-speed revolution of rotating grindstone combined with the action of ejection wings for suction and can finely pulverize the pulverizing raw material fed from the opening of fixed grindstone at ambient temperature without raising temperature, allowing the fine pulverization of materials containing high lipid, high moisture, high protein, saccharide, enzyme or the like without changes by heat.

EXAMPLE 2

Figure 3:
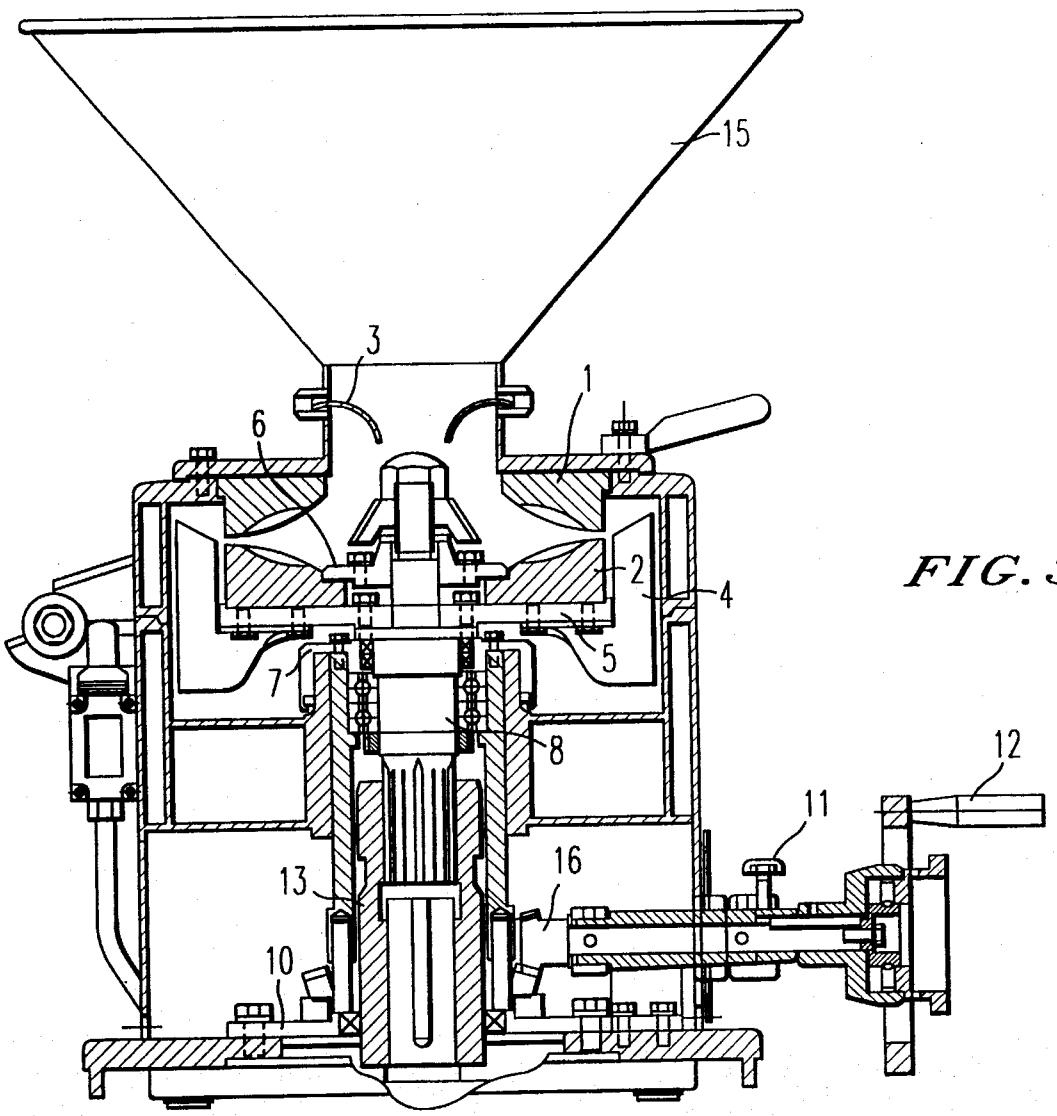
FIG. 3 is a longitudinal sectional view showing the pulverizing portion of the high-speed fine pulverizer involved in a second embodiment of the invention.

Next, a second embodiment of ambient temperature high-speed fine pulverizers is shown in FIG. 3. Similar to Example 1, in the upper chamber is housed a deep-groove type fixed grindstone (1) and a lower chamber housed a deep-groove type rotating grindstone (2) are made to be freely openable by a hinge as indicated by dotted lines, which are unified to constitute a pulverizing chamber with a reduced pressure-tolerable function. Onto a hopper (15) for feeding pulverizing raw material in upper chamber, metal fittings (3) for preventing the return of powder flow are attached. The rotating grindstone (2) is fixed to a rotating disk (5) provided therearound with a plurality of ejection wings (4) at equal intervals in the circumferential direction. Numeral (6) indicates metal fittings for pressing down the stone, numeral (7) a bearing cover, numeral (8) a shaft, numeral (16) a bevel gear, numeral (10) a waterproof board, numeral (11) a lock handle, numeral (12) an up and down handle, and numeral (13) a joint, respectively.

Figure 4:
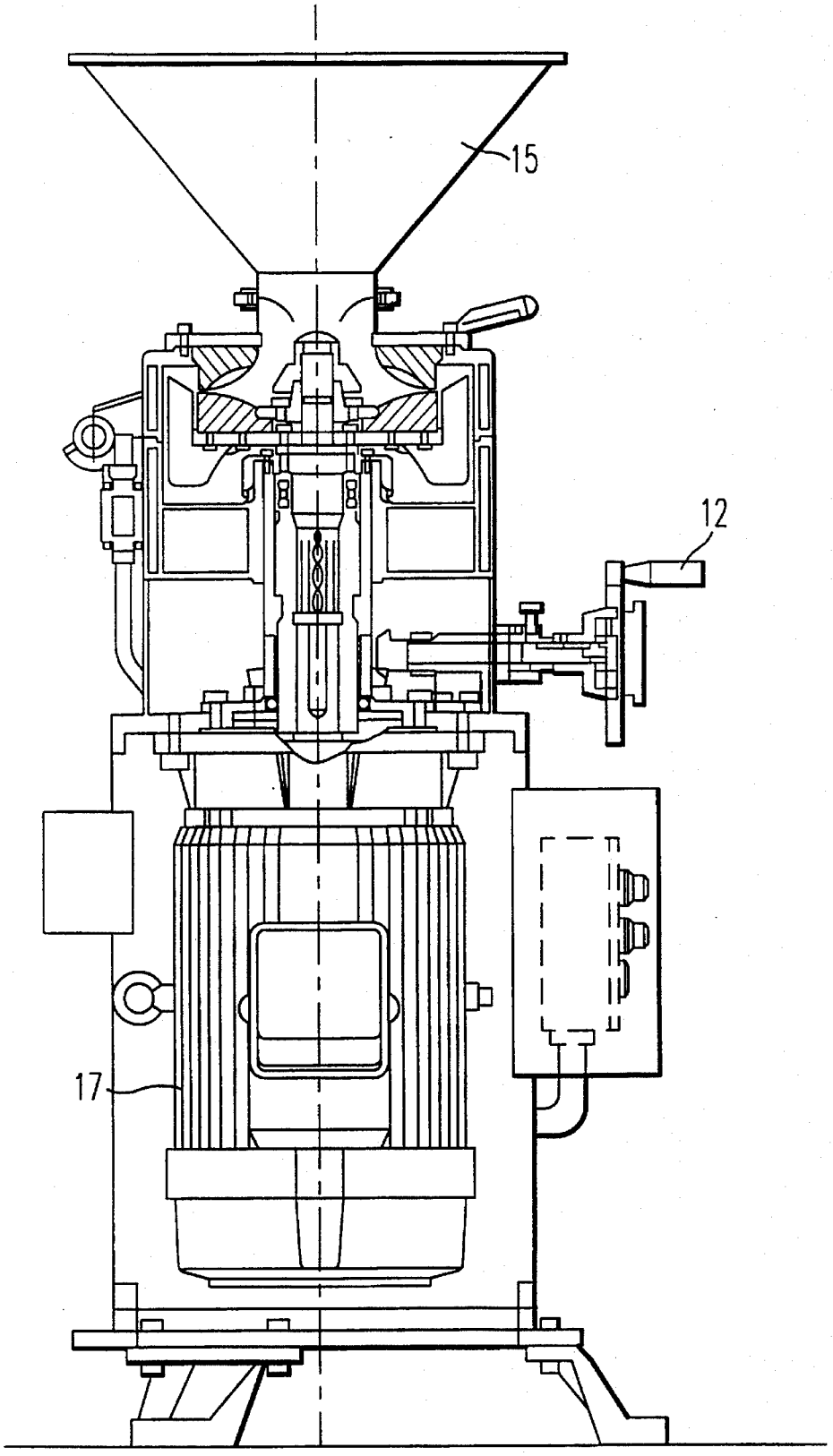
FIG. 4 is a longitudinal sectional view showing a portion of the same high-speed fine pulverizer.
Figure 5:
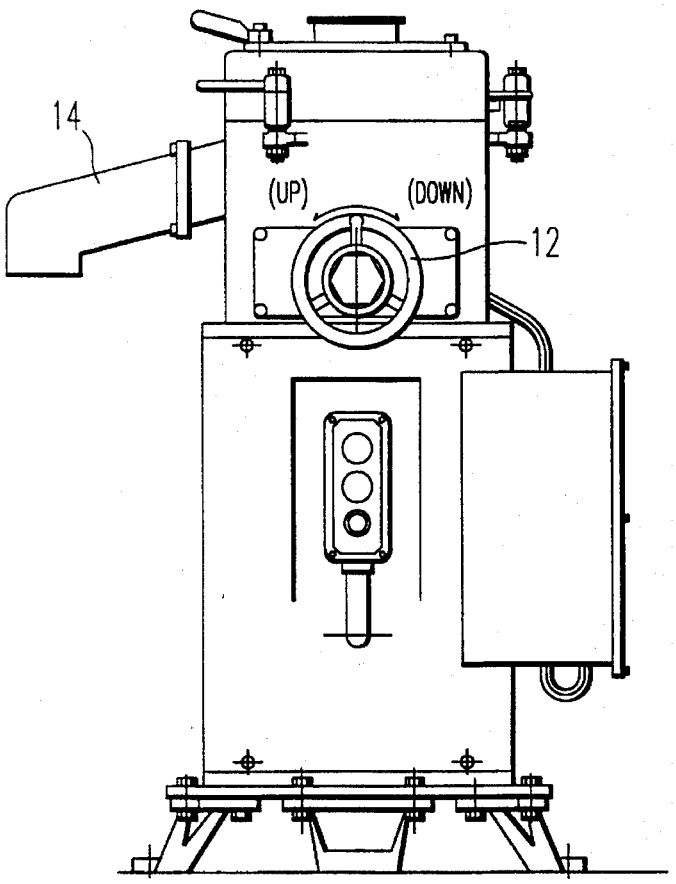
FIG. 5 is a side view showing the overall appearance of the high-speed fine pulverizer.

Besides, in FIG. 3, only the pulverizing portion of a fine pulverizer is shown. A side section of overall pulverizer with the output axis of a motor (17) as a drive source connected directly to the shaft (8) through said joint (13) is shown in FIG. 4, and further a side view of the overall appearance of the main body of said pulverizer is shown in FIG. 5, omitting feed hopper (15). Besides, in FIG. 5, numeral (14) is an ejection port for pulverized powder.

Figure 6:
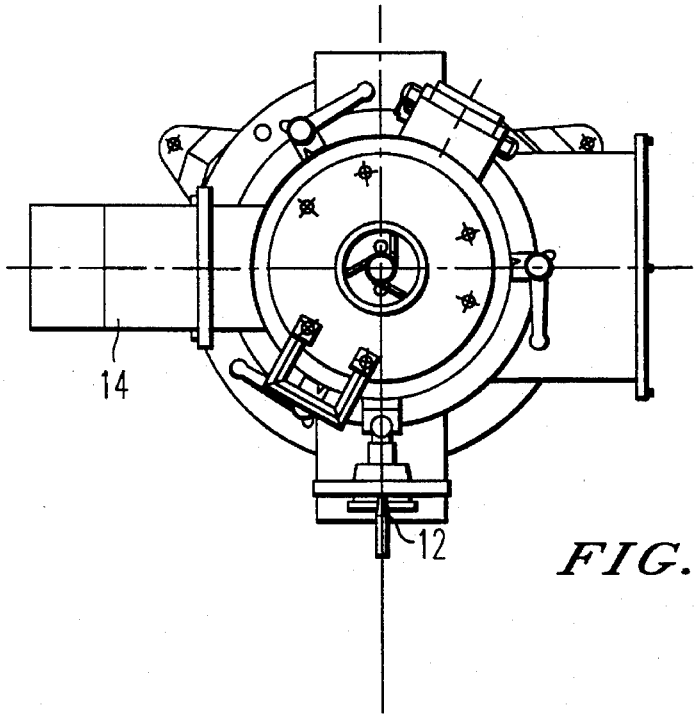
FIG. 6 is a plan views showing the same high-speed fine pulverizer.
Figure 7:
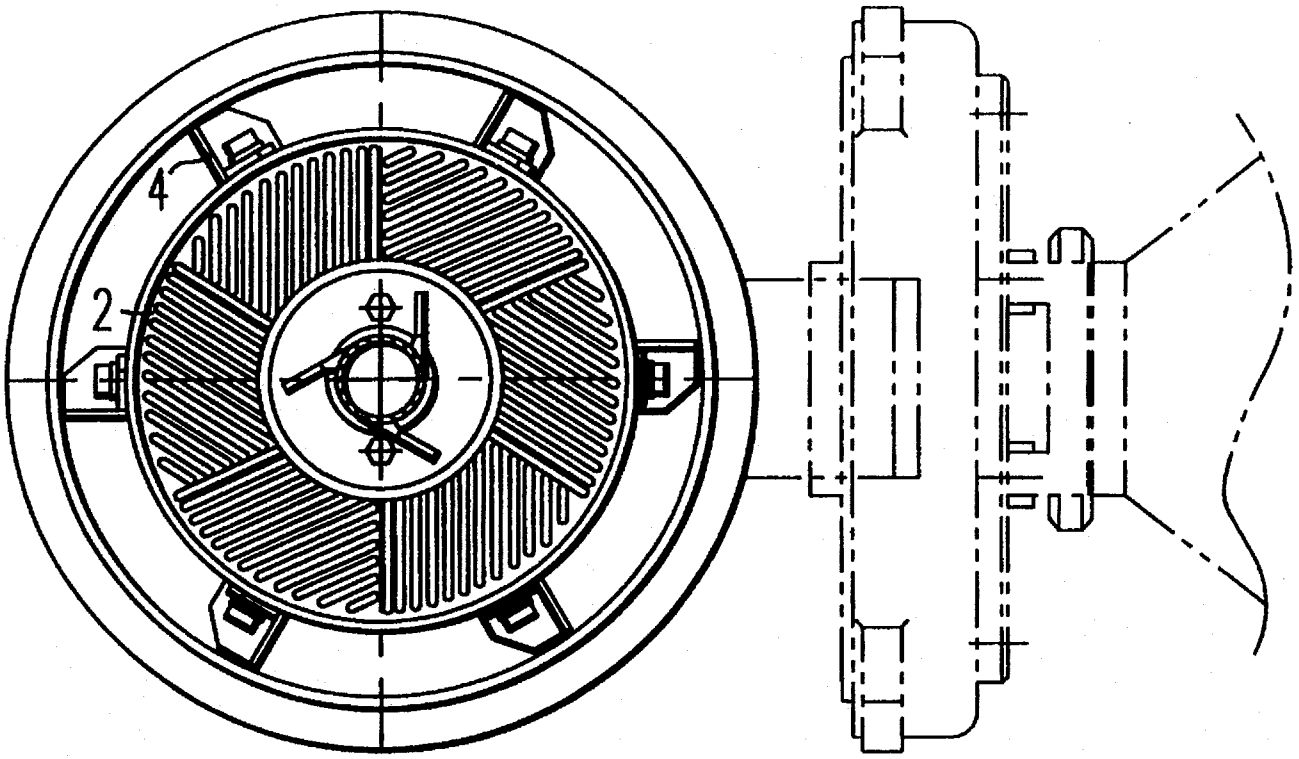
FIG. 7 is a plan view showing portions of the upper chamber upon being opened in the same high-speed fine pulverizer.

In addition, a plan view of the main body of said pulverizer is shown in FIG. 6 and internal arrangements of the rotating grindstone (2) and ejection wings (4) when opened the upper chamber of said pulverizing portion are shown in FIG. 7.

Figure 8:
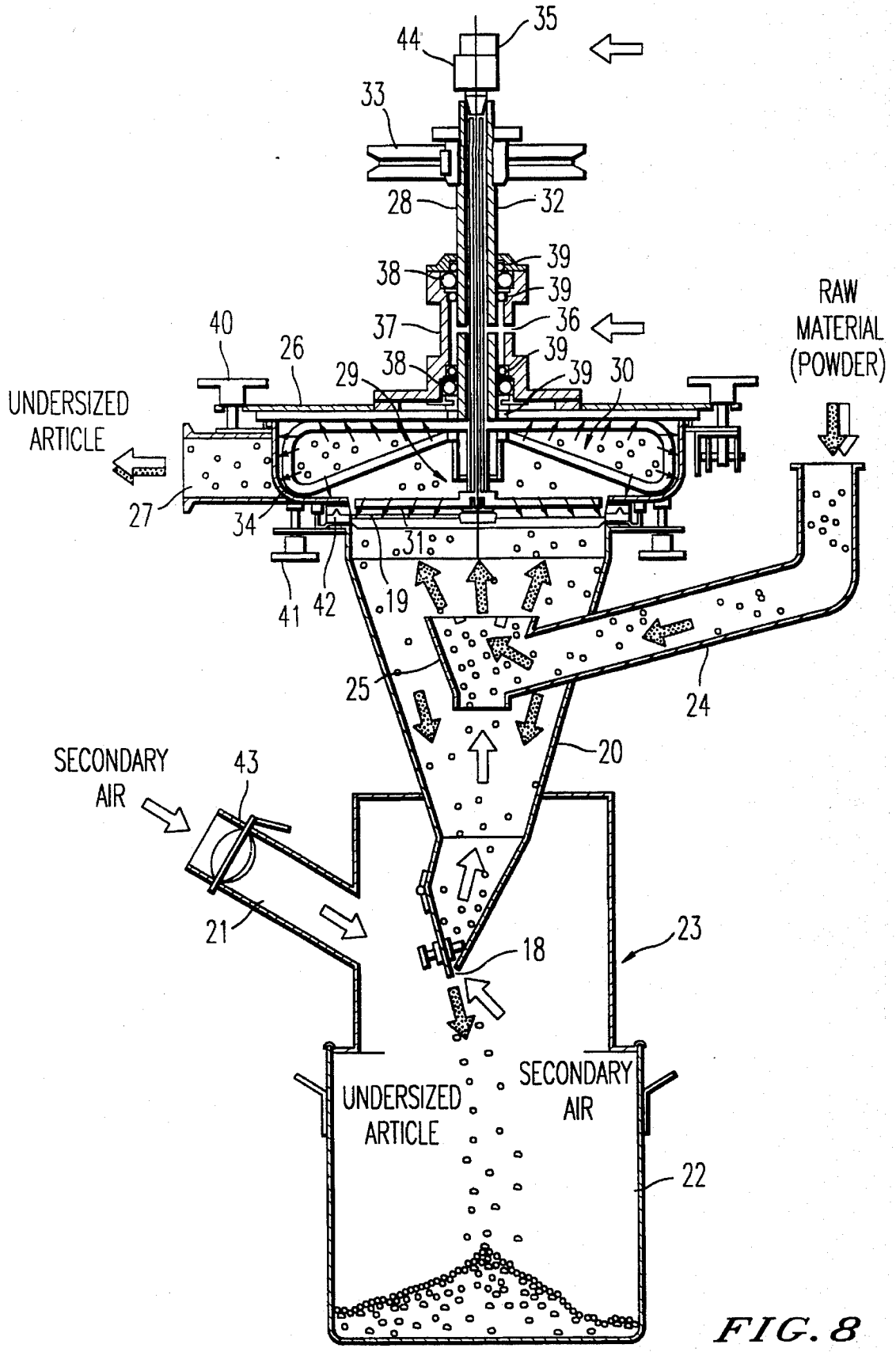
FIG. 8 is a longitudinal sectional diagram of an air classifier according to the invention.

Next, an air classifier for classifying the powder obtained by dry-pulverizing with said high-speed fine pulverizer is shown in FIG. 8.

Namely, it has a lower casing space in the shape of an inverted partial portion of a truncated cone, and the lower end of lower casing (20) provided with a lower end opening (18) and a circular classification or filtration screen (19) at an upper end is installed in a powder recovery case (23) with secondary air intake pipe (21) formed on the side and with a freely detachable powder collecting pot (22) at a lower portion thereof. Into this lower casing (20), a feed pipe (24) for feeding raw material powder from outside was introduced, and, at the tip thereof, a jet vessel (25) with top-through-bottom penetrated passage in the shape of inverted truncated cone is installed coinciding with the longitudinal center axis of said lower casing (20).

Further, the air classifier has an upper casing space in the shape of flat cylinder communicating with the lower casing space via the classification screen (19), and the upper casing is (26) provided with a powder exit (27) on the side which is installed at the upper end of said lower casing (20). In this upper casing (26), a following air brush for screen (29) and an air brush for the casing (30) which is rotatable horizontally by a main shaft (28) coinciding with said longitudinal center axis are installed.

First, the air brush for screen (29) comprises a hollow straight tube (31) with slits for emitting high-pressure air formed in the axial direction, and, to the center thereof in the axial direction, a shaft pipe (32) communicating internal spaces with one another is connected in a T shape, wherein said shaft pipe (32) is inserted into said main shaft (28), and said hollow straight tube (31) is installed on the supper side of said circular classification screen (19) along the diameter thereof.

The air classifier therefore has a structure such that said air brush for the screen (29) revolves over the circular classification screen (19) by the shaft pipe (32) unified with the main shaft (28) driven in rotation by a pulley (33), making the center of said hollow straight tube (31) in the axial direction be a revolutionary center. Hence, by supplying the high-pressure air through shaft pipe (32), the high-pressure air can flow from the slits of hollow straight tube (31) over the overall upper surface of circular classification screen (10).

Secondly, the air brush for casing (30) comprises the main shaft (28) which is a hollow structure capable of supplying high-pressure air toward the inside and a hollow pipe (34) communicating internal spaces with one another, and said pipe (34) is provided in the radial direction along the upper face of upper casing (26), extended and curved downward in the longitudinal direction so as to located along the sides of said upper casing (26) and further curved obliquely upward toward the inside to fix the tip thereof in the vicinity of a connected portion of the main shaft (28) to said hollow pipe (34). On said hollow pipe (34), slits are formed toward the outside thereof in the axial direction of said pipe (34) at the locations along said upper surface in the radial direction and the locations along the sides of upper casing (26). In addition, the hollow pipe (34) is installed orthogonally with respect to the main shaft (28) in the upper casing (26), as shown in FIG. 8.

Said air brush for casing (30) therefore revolves in the upper casing (26) by the main shaft (28) revolving by action of the pulley (33). Hence, by supplying the high-pressure air through said main shaft (28), the high-pressure air can be spouted over the overall surfaces of the upper wall and side wall.

For classifying the pulverized powder obtainable by pulverizing at ambient temperature with the ambient temperature high-speed fine pulverizer with said structure and ejecting from the clearance between rotating grindstone and fixed grindstone to outside, the pulverized powder is projected into the feed pipe (24) of said air classifier. More preferably, air to be sucked and emitted is also introduced at the same time as the projected pulverized powder. Since a suction blower (not shown) in the diagram is connected to the powder exit (27) of said air classifier, the flow of air in said classifier always goes from lower portion toward said exit (27).

In addition, the air flowing in through the secondary air intake pipe (21) enters from lower end opening (18) of lower casing (20) into said casing (20) and passes through the jet vessel (25). At this time, the air diffuses toward the overall lower surface of circular classification or filtration screen (19) in a high-speed jet stream, and the powder reaching said vessel (25) rides this jet stream upwardly and reaches the lower surface of said classification screen (19) in the atomized state while being released from flocculation.

Thereafter, the powder smaller than the mesh of said classification screen (19) passes through said screen (19) by the suction force of said suction blower to enter the upper casing (26) and it is further conveyed to a collector such as cyclone connected to the exit of powder (27) and not shown in the diagram for recovery. On the other hand, the oversized powder incapable of passing through the classification screen (19) is collected on said screen (19) and adheres thereto. However, since the high-pressure air is continuously spouted downward from the slits formed in the axial direction of hollow straight tube (31) of air brush (29) by revolution of said straight tube (31) provided above said classification screen (19) in the radial direction thereof, thus spouting the highpressure air everywhere while periodically changing the spouting positions of air, this oversized powder is blown away downwardly, thus descending gradually and falling from the lower end opening (18) of lower casing (20) into the powder-accommodating pot (22) under the powder recovery case (23) due to its own weight or the gyrating stream of air caused by the revolution of said air brush for screen (29) and air brush for casing (30). However, the undersized fine powder that drops together with said oversized powder in the embraced state and is going to be discharged outside the machine is separated again to fly upwardly by the secondary air take-in from said lower end opening (18). The oversized powder accommodated in the powder-accommodating pot (22) in this way is returned again to said high-speed fine pulverizer to retreat and is projected again into said air classifier.

In this example, the high-pressure air for backwashing of classification screen from such air brush for screen (29) was spouted continuously while revolving said air brush, but it may be intermittent Moreover, the air brush for casing (30) detaches the fine powder adhering onto the inner wall of upper casing (26) by spouting high-pressure air, and the spouting of this high-pressure air may also be continuous or intermittent.

Moreover, FIG. 8 shows an air-supply port of the air brush for screen (35) and an air-supply port of air brush for casing (36), each provided separately and independently, which is convenient because the pressure, supplying time and timing of high-pressure air can be set each independently, but these air-supply ports (35) and (36) may be the same one.

Furthermore, in the classifier filter of FIG. 8, an air seal mechanism is provided, wherein the high-pressure air is supplied also into bearing housing (37) to increase the inner pressure, thus preventing the intrusion of powder into the bearing housing.

Still more, this classifier requires only the drive force to resolve the air brushes, making the power necessary very low and also making the noise and vibrations generated low. Moreover, due to being a fully closed system, it runs without dust being generated.

Moreover, in the diagram, numeral (38) indicates a bearing, numeral (39) an oil seal, numeral (40) an opening and shutting handle of upper casing, numeral (41) an opening and shutting handle of lower casing, numeral (42) a pressing-down frame for screen, numeral (43) a damper for adjusting the amount of secondary air, and numeral (44) a rotary joint, respectively.

Figure 9:
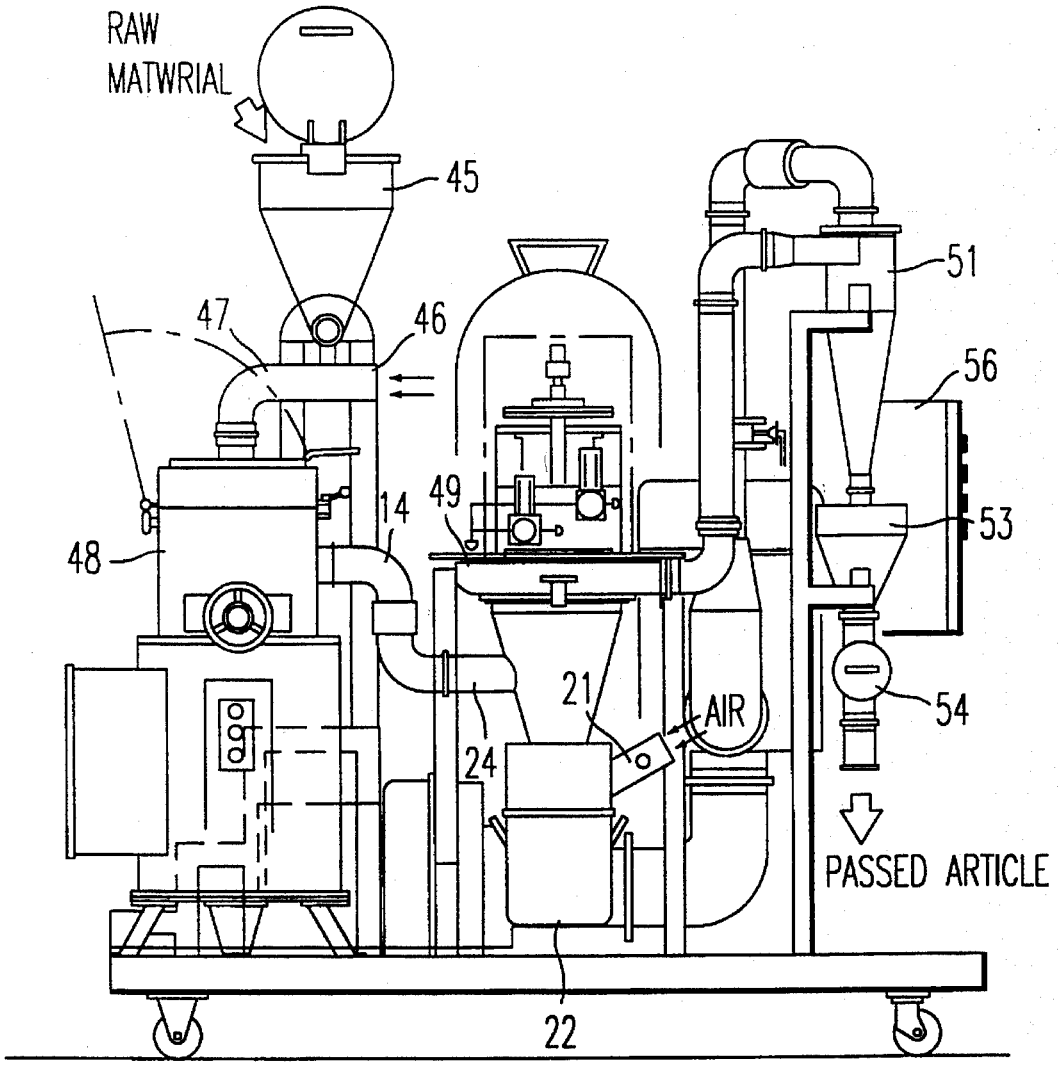
FIG. 9 is a front view showing equipment used to carry out the automatic classification using the inventive equipment.
Figure 10:
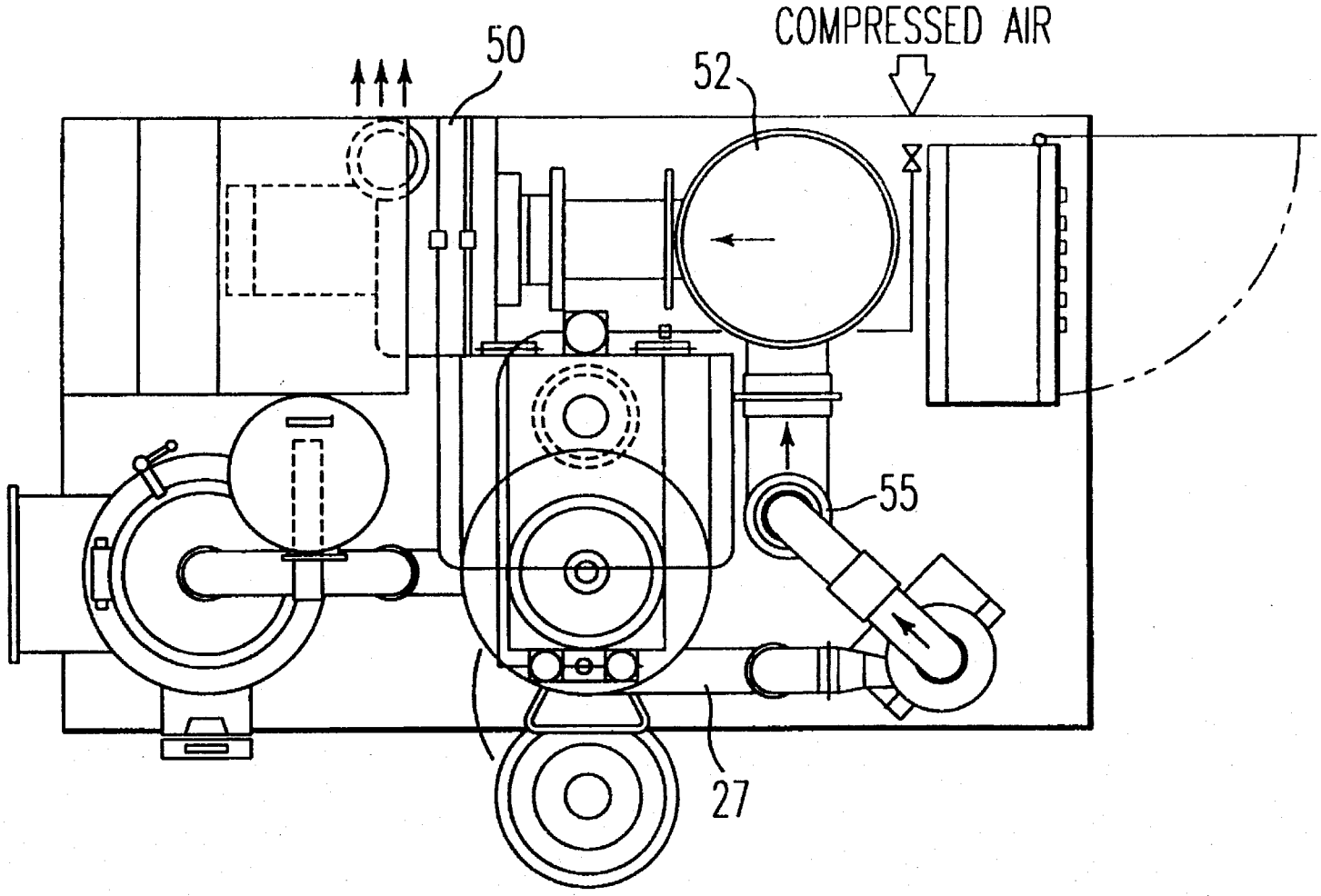
FIG. 10 is a plan view thereof.

Next, an example of actual installation of the inventive equipment is shown in FIG. 9 and FIG. 10.

The raw material is fed from a hopper (45) equipped with screw feeder, into which the pulverizing raw material was thrown, to the central opening of fixed top grindstone of high-speed fine pulverizer (48) via a feed pipe (47) having air-supply port (46), and, by connecting an ejection port (14) of pulverized powder being to a feed pipe (24) of air classifier (49), the finely pulverized powder ground at ambient temperature and pulverized at ambient temperature between outer circumferential flat areas of said fixed grindstone and rotating grindstone is classified or filtered with said classifier via the feed pipe (24), and the undersized powder is sucked by a blower (50) communicating to a powder exit (27) to be taken out as a powder product with uniform particle size through a cyclone (51) and further the powder with very fine particle size is removed at the section of filter (52).

Moreover, the oversized powder classified with air classifier (49) is accommodated in a powder-accommodating pot (22) and then returned again to hopper (45). In this way, starting from the throwing-in of raw material, fine pulverization, classification and collection can be-automated completely.

In the diagrams, numeral (53) indicates a chamber, numeral (54) a rotary valve, numeral (55) a volume damper, and numeral (56) an operation board, respectively.

In addition, if directly connecting the high-speed fine pulverizer to the air classifier in this way, the pulverized powder finely pulverized with the fine pulverizer directly receives the sucking action from the ejection port and is placed in an environment liable to more easily generate the spinning jet stream in the high-speed fine pulverizer, which connects with the speed-increasing effect on said steam, resulting in an increase in the magnification of cooling function. Consequently, the quality of finely pulverized powder becomes closer to natural one, thus realizing a high-speed pulverization without raising temperature.

As descried above, in accordance with the equipment of the invention for producing pulverized powder, the powder finely dry-pulverized at high speed and at ambient temperature can be classified continuously with good efficiency, hence it becomes possible to continuously and massively produce he pulverized power with constant particle size, which was difficult hitherto, and yet it is possible to easily constitute an automatic system for he production of pulverized powder.

What is claimed is:

1. A method for producing finely pulverized powder, which comprises:

concentrically arranging a rotating grindstone having a flat grinding area at an outer circumference thereof and a fixed grindstone having a flat grinding area at an outer circumference thereof so that the flat grinding areas of said fixed and rotating grindstones are opposed to one another and forming a clearance therebetween of 100 to 3,000 μm;

mounting a plurality of ejection wings generating suction around said rotating bottom grindstone;

generating a reduced-pressure jet stream through said clearance while revolving and rotating grindstone and said ejection wings at high speed;

grinding and pulverizing raw material fed from a central opening of said fixed grindstone and forced between the grinding areas of the fixed and rotating grindstones;

positioning a jetting vessel in the shape of an inverted cone in a lower casing and jetting air therefrom towards a filtration screen located above the lower casing;

feeding the powder obtained from said grinding and pulverizing to the jetting vessel;

passing the powder through the filtration screen by jetting high-pressure air thereagainst by the jetting vessel;

conveying the fine powder passed through the filtration screen and further processing the fine powder via an exit member; and ejecting powder not passed through said filtration screen from a lower end opening of the lower casing and returning the powder not passed through the filtration screen again to the grindstone grinding areas of the fixed grindstone and rotating the rotating grindstone for further and rotating grindstones and pulverization of the powder.

2. Apparatus for producing finely pulverized powder, including an ambient temperature high-speed fine pulverizer, which comprises:

a fixed grindstone with radially engraved feed grooves and a flat grinding area located at an outer circumference thereof;

a pulverizing chamber with a reduced pressure environment;

a rotatable bottom grindstone located in the pulverizing chamber, the rotating grindstone having radially engraved feed grooves and a flat grinding area located at an outer circumference thereof opposed to said fixed grindstone and forming a clearance therebetween of 100 to 3,000 μm;

a rotating disk upon which the grindstone is located, the disk having a plurality of ejection wings for generating suction upon rotation of the rotating disk wherein a reduced-pressure jet steam is generated by rotating the ejection wings so as to suck air from the clearance formed between the fixed grindstone and rotating grindstone and pulverizing raw material is forcedly passed through the clearance while the raw material is whirled so as to be finely pulverized and wherein temperature-raising energy due to rolling, shear, compression and heat of friction generated upon pulverization is reduced by said jet stream by exerting a cooling effect on the fixed grindstone and rotating grindstone; and an air filtration screen receiving the pulverized raw material;

a jetting vessel having a passage in the shape of an inverted truncated cone and provided at a tip portion of a feed pipe located in proximity with the filtration screen, said jetting vessel introducing powder obtained from said pulverized raw material, said jetting vessel being located in a lower casing located below said filtration screen and said lower casing having an opening at a lower end thereof;

an upper casing positioned on said lower casing and having a powder exit connected to an external air suction source, said filtration screen separating the lower casing from the upper casing;

an air brush blowing high-pressure air against said filtration screen wherein said air brush is provided above said filtration screen; and a powder recovery case wherein a lower end of the lower casing is positioned in the powder recovery case, an external air-introductory port is provided in said casing and a freely detachable powder accommodating pot is located at the lower portion of the casing wherein powder introduced from said feed pipe by a rising jet stream of air in the jetting vessel is sucked from the lower end opening of the lower casing and is classified into one of undersized powder passing through the filtration screen for ejecting from a powder exit and oversized powder not passing through the filtration screen so as to fall and be deposited into the power-accommodating pot.

3. The apparatus for producing finely pulverized powder of claim 2, wherein the filtration screen is circular and the air brush includes a hollow straight tube with air-purging slits formed in a longitudinal direction thereof wherein the air brush is rotatably mounted above a center portion of the filtration screen, said tube revolving so that the high-pressure air spouts spay air over a top surface portion of said filtration screen.

4. The apparatus for producing finely pulverized powder as claimed in claim 2 or 3, wherein the ejecting port is connected to an entrance of the feed pipe.

5. The apparatus for producing finely pulverized powder of claim 2, wherein the filtration screen is circular and separates the lower casing from the upper casing and wherein the powder introduced to the filtration screen rising from said jetting vessel is atomized, sucked from a lower end opening of the lower casing and is classified into one of undersized powder passing through the filtration screen so as to be ejected from the powder exit and oversized powder not passing through the screen so as to fall and be deposited in the powder-accommodating pot.

* * * * *